US011326458B2

(12) United States Patent
Ahmad et al.

(10) Patent No.: US 11,326,458 B2
(45) Date of Patent: May 10, 2022

(54) AEROFOIL FOR A TURBINE BLADE

(71) Applicant: Siemens Energy Global GmbH & Co. KG, Munich (DE)

(72) Inventors: Fathi Ahmad, Kaarst (DE); Daniela Koch, Berlin (DE); Marco Schüler, Potsdam (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/048,582

(22) PCT Filed: May 3, 2019

(86) PCT No.: PCT/EP2019/061354
§ 371 (c)(1),
(2) Date: Oct. 17, 2020

(87) PCT Pub. No.: WO2019/211427
PCT Pub. Date: Nov. 7, 2019

(65) Prior Publication Data

US 2021/0156263 A1 May 27, 2021

(30) Foreign Application Priority Data

May 4, 2018 (EP) ..... 18170731

(51) Int. Cl.
*F01D 5/18* (2006.01)

(52) U.S. Cl.
CPC ..... *F01D 5/186* (2013.01); *F05D 2220/32* (2013.01); *F05D 2240/303* (2013.01); *F05D 2260/202* (2013.01)

(58) Field of Classification Search
CPC ..... F01D 5/186; F01D 5/187; F01D 9/065; F01D 25/12; F05D 2240/303; F05D 2220/32; F05D 2260/202
See application file for complete search history.

(56) References Cited

U.S. PATENT DOCUMENTS 6,869,268 B2 * 3/2005 Liang ..... F01D 5/186 415/115
7,997,866 B2 * 8/2011 Naik ..... F01D 5/186 416/97 R (Continued)

FOREIGN PATENT DOCUMENTS

| | | |
|---|---|---|
| EP | 2154333 A2 | 2/2010 |
| EP | 3043026 A2 | 7/2016 |
| JP | 2006112429 A | 4/2006 |

OTHER PUBLICATIONS

PCT International Search Report and Written Opinion of International Searching Authority dated Jul. 24, 2019 corresponding to PCT International Application No. PCT/EP2019/061354 filed May 3, 2019.

*Primary Examiner* — Eldon T Brockman

(57) ABSTRACT

An aerofoil for a turbine blade, having a leading edge onto which a hot gas can flow and from which a suction-side wall and a pressure-side wall extend to a trailing edge of the aerofoil, the aerofoil extending in a direction transverse thereto from a root-side end having an aerofoil height of 0% to a tip-side end having an aerofoil height of 100%, and having at least two rows of cooling holes arranged along the leading edge, which cooling holes are at a mutual spacing which can be measured perpendicularly to the leading edge. In order to provide a turbine blade which can be used, with reduced cooling complexity, for additional reliable cooling of the leading edge in various operating conditions, the at least two rows of cooling holes are arranged at least in part in a wavy line along the leading edge.

16 Claims, 4 Drawing Sheets

(56) References Cited

U.S. PATENT DOCUMENTS

| | | | | |
|---|---|---|---|---|
| 8,105,030 | B2 * | 1/2012 | Abdel-Messeh | F01D 5/187 416/95 |
| 10,329,923 | B2 * | 6/2019 | Slavens | F01D 5/186 |
| 2006/0083614 | A1 | 4/2006 | Cunha et al. | |
| 2008/0095622 | A1 * | 4/2008 | Naik | F01D 5/186 416/97 R |
| 2016/0010463 | A1 * | 1/2016 | Quach | F01D 5/186 60/806 |
| 2016/0010465 | A1 * | 1/2016 | Slavens | F01D 5/186 415/115 |
| 2017/0218769 | A1 | 8/2017 | Venugopal et al. | |
| 2018/0073369 | A1 | 3/2018 | Lewis et al. | |
| 2021/0156263 | A1 * | 5/2021 | Ahmad | F01D 5/186 |

* cited by examiner

AEROFOIL FOR A TURBINE BLADE

CROSS REFERENCE TO RELATED APPLICATIONS

This application is the US National Stage of International Application No. PCT/EP2019/061354 filed 3 May 2019, and claims the benefit thereof. The International Application claims the benefit of European Application No. EP18170731 filed 4 May 2018. All of the applications are incorporated by reference herein in their entirety.

FIELD OF INVENTION

The invention relates to an airfoil for a turbine blade, comprising a leading edge against which a hot gas is able to flow and from which a suction-side wall and a pressure-side wall extend to a trailing edge of the airfoil, wherein, in a transverse direction with respect thereto, the airfoil extends from a root-side end at an airfoil height of 0% to a tip-side end at an airfoil height of 100%, having at least two series of cooling holes that are arranged along the leading edge, which, with respect to one another, have a first spacing which is to be measured perpendicularly to the leading edge.

BACKGROUND OF INVENTION

A turbine blade of said type is known for example from EP 2 154 333 A2. The cooling holes arranged in the leading edge, during the operation of a gas turbine provided therewith, serve for generating a cooling protective film over the leading edge in order to counteract the incoming hot-gas flow. The cooling holes are therefore also referred to as film-cooling holes, which, owing to their close arrangement, are moreover also referred to as "showerhead film-cooling holes". At the same time, at the leading edge, the airfoil divides the incident hot-gas flow into two partial streams, of which one partial stream flows along the suction side of the airfoil and the other part flows along the pressure side. The location of the flow division on the blade profile is referred to here as a stagnation point since, in an idealized sense, no transverse flow occurs there. For this reason, in the prior art, there are arranged on both sides of the leading edge, or of the stagnation line determined beforehand, film-cooling holes, in order not to allow the hot-gas flow impinging there to come into excessively close contact with the component wall.

However, a disadvantage is that the stagnation point of a blade profile or the stagnation line of an airfoil can be dependent on different influencing factors, and so there is a need for the turbine blade and its airfoil and also its leading-edge cooling means to be adapted as best as possible to the different operating conditions.

In this regard, US 2016/0010463 A1 teaches, in the case of displacement of the stagnation line, arranging on the pressure side of rotor blades an additional half series of film-cooling holes on the radially outer half of the airfoil. However, the additional film-cooling holes increase the consumption of cooling air, which has an adverse effect on the efficiency of a turbine provided therewith.

According to EP 3 043 026 A2, adapted cooling can also be achieved in that, for a displacement, determined beforehand, of the stagnation line, not the position but only the inclination of some leading-edge film-cooling holes is selected such that, with respect to the expected local hot-gas flow, said holes blow out the cooling air not in the opposite direction but in the same direction.

SUMMARY OF INVENTION

Proceeding from the above-described prior art, the invention is based on the object of providing an airfoil for a turbine blade that has the best possible design for different operating conditions of a gas turbine, in particular to achieve, with an acceptable amount of cooling medium used, sufficient cooling with the longest possible service life of the airfoil.

Said object is achieved by an airfoil of the type mentioned in the introduction in that the at least two series of cooling holes are arranged at least partially on a wavy line along the leading edge.

The invention is based on the finding that, on the one hand, the actual hot-gas flow direction can differ from the flow direction taken into consideration for the design of the airfoil, owing to different modes of operation of the gas turbine. The differences can occur owing to a load output which is changed in relation to the rated load. Secondly, it has been found that, in particular for rotor blades, the stagnation point of a blade profile in the region of the leading edge can oscillate owing to flow effects which are induced by a guide blade arranged upstream of the rotor blade. The oscillation of the stagnation point of a blade profile leads to a locally increased surface temperature of the airfoil, which can be countered in an effective manner by the invention.

In order to counteract both effects, it is now proposed with the invention to provide in the region of the leading edge at least two series of cooling holes that are arranged at least partially on a curved wavy line. The cooling holes are displaced to the pressure side or suction side, with respect to the oscillating stagnation point of the respective blade profile. During the design phase, a region in which the stagnation point can occur is determined for each blade profile. Each of these regions is defined by two end points, from which a central stagnation point is then able to be determined. Subsequently, the two cooling holes are positioned in such a way that the best possible cooling is achieved. In this way, the cooling effect can be locally optimized. The use of only two cooling series instead of normally three or more complete cooling series moreover allows the amount of cooling medium required for cooling to be reduced. The reduced consumption of cooling medium contributes, during the operation of the gas turbine, to the increase in efficiency of the latter.

Further advantageous measures are listed in the dependent claims and may be combined with one another in any desired manner. In this way, further advantages can be obtained.

According to a first advantageous configuration of the invention, the at least two series of cooling holes are arranged on a wavy line, having multiple wave troughs and wave peaks, along the entire extent of the leading edge between 0% and 100% airfoil height. Consequently, the cooling holes of the at least two series are repeatedly locally displaced slightly to the pressure side in comparison with cooling holes at another airfoil height.

According to an alternative configuration, the at least two series of cooling holes are arranged only partially on a wavy line along the leading edge, such that the at least two series of cooling holes are, in a first region, which is arranged between 0% and approximately 40% airfoil height, arranged on both sides of the leading edge in a substantially parallel manner and, in a second region, which directly adjoins said first region and extends between approximately 40% and approximately 75% airfoil height and higher, arranged so as to be shifted to the pressure side, and wherein the at least two series of cooling holes are, in a third region, which directly adjoins the second region and ends at 100% airfoil height, arranged so as to be shifted back toward the leading edge again with increasing airfoil height.

This configuration is based on the finding that the displacement of the stagnation point of a blade profile in the radially inner region of the airfoil is more in a narrow range, whereas, from an airfoil height of approximately 40%, the displacement increases and is moreover more on the pressure side. Accordingly, the cooling holes of the at least two series in the region from 40% to 100% are displaced to the pressure side, wherein advantageously, at approximately 75% airfoil height, the maximum pressure-side displacement is arranged. With respect to a chord length of the airfoil, the value of the maximum displacement on the pressure side is not more than 5% of the blade chord length, but is advantageously at least 2% as a minimum.

In this respect, the result for the at least two series of cooling holes is a more straight configuration in the region from 0% to 40% airfoil height and a contour of the series that is curved to the pressure side for the section between 40% and 100% airfoil height. In particular for different operating points, for example for low partial load, such displacements of the stagnation line occur, and so a blade which is provided for a particularly flexibly operated gas turbine has such a configuration.

In addition to the aforementioned configurations, it is particularly advantageous if the first spacing between the at least two series of cooling holes varies along the leading edge, so that the first spacing is of a different size for some airfoil heights. By way of this measure, it is possible to locally adapt to the individual temperature load the local cooling capacity of the turbine blade in the region of the leading edge.

It goes without saying that a blade profile is able to be determined, by a cross-sectional view, for any airfoil height, which blade profile is known to have the shape of a curved drop. Consequently, each blade profile has a nose radius in the region of the leading edge, wherein, at the height of cooling holes, the blade profiles have between the at least two series a first spacing whose size lies in the range between 0.4 and 0.7 times the associated nose radius. Thorough investigations have found that the effectiveness of the cooling depends on the spacing of the cooling holes of different series and on the curvature of the leading edge, on the so-called nose radius and on the length of the camber line, on the number of blades and on the turning of the blade profile. It has subsequently been established that particularly efficient cooling of the leading-edge region can be achieved when the first spacing between the cooling holes of different series that are situated at the same airfoil height lies in the claimed interval.

According to a further advantageous configuration, the first spacing, at the airfoil mid-height, is at its smallest and increases toward the two ends. The increase is in particular moderate.

In order to further adapt the cooling of the leading edge for different airfoil heights according to requirement, it is advantageously the case that each cooling hole has a throttle cross section which sets the cooling medium throughflow, wherein the throttle cross sections of some cooling holes are of different sizes. Particularly advantageously, the throttle cross sections of the cooling holes in the region of the airfoil mid-height are larger than the throttle cross section of the cooling holes in the region further away from the airfoil mid-height.

This embodiment is based on the finding that, at the airfoil mid-height and the regions directly adjoining the latter, there prevails a cooling requirement which is slightly higher than in those regions of the leading edge which are situated further away from the airfoil mid-height.

Of particular advantage is that configuration in which the at least two series of cooling holes are arranged on both sides of a central stagnation point line of the incoming hot-gas flow. At this position, the hot-gas flow is divided into a fraction flowing to the pressure side, and a fraction flowing to the suction side, so as to be diverted to both sides in a divided manner, so that, owing to the arrangement of the cooling holes on both sides, the component wall situated therebelow is protected particularly efficiently from the high temperatures of the hot gas.

According to a further advantageous configuration, both near the root-side end and near the tip-side end of the airfoil, the cooling holes of each of the at least two series are arranged further to the suction side than the cooling holes of the corresponding series at the airfoil mid-height. The wavy line then extends between these points without a change in sign of its curvature such that it is only slightly curved. Thorough investigations have shown that this variant represents in particular for guide blades a more favorable cooling configuration since, for these blades, the stagnation point displacement occurs much more at the ends of the airfoil than in the center thereof and moreover to the suction side. The maximum displacement of the respective cooling holes close to the ends of the airfoil is then only a few millimeters, in particular 2 mm, to the suction side, compared with the position of the cooling holes of the same series at the airfoil mid-height, that is to say at 50% of the airfoil height.

Depending on configuration, for avoiding local thermal overloading of the leading edge, it may also be helpful if, in the aforementioned configuration, beside the at least two series, a further, albeit shortened, series of substantially uniformly spaced-apart cooling holes is provided on the pressure side, wherein the length of the further series is between 50% and 60% of the airfoil height, and the further series of cooling holes is arranged substantially centrally between the two ends of the airfoil. Within the context of the present application, the further series is arranged substantially centrally as long as this is divided by the airfoil mid-height into two parts whose shorter part is not shorter than ⅓ of the length of the further series. The length of the further series of cooling holes is measured in the same direction as the airfoil height.

The airfoil is advantageously part of a turbine blade, in particular a turbine blade for a stationary gas turbine.

BRIEF DESCRIPTION OF THE DRAWINGS

The invention will now be described and discussed in more detail below on the basis of the exemplary embodiments illustrated in the figures, in which.

DETAILED DESCRIPTION OF INVENTION

In the exemplary embodiments and figures, identical features or features having an identical effect can each be denoted by the same reference signs. The illustrated features and their sizes relative to one another are fundamentally not to be regarded as being true to scale, but rather, for better illustration and/or for better understanding, individual elements can be illustrated with relatively larger dimensions.

Figure 1:
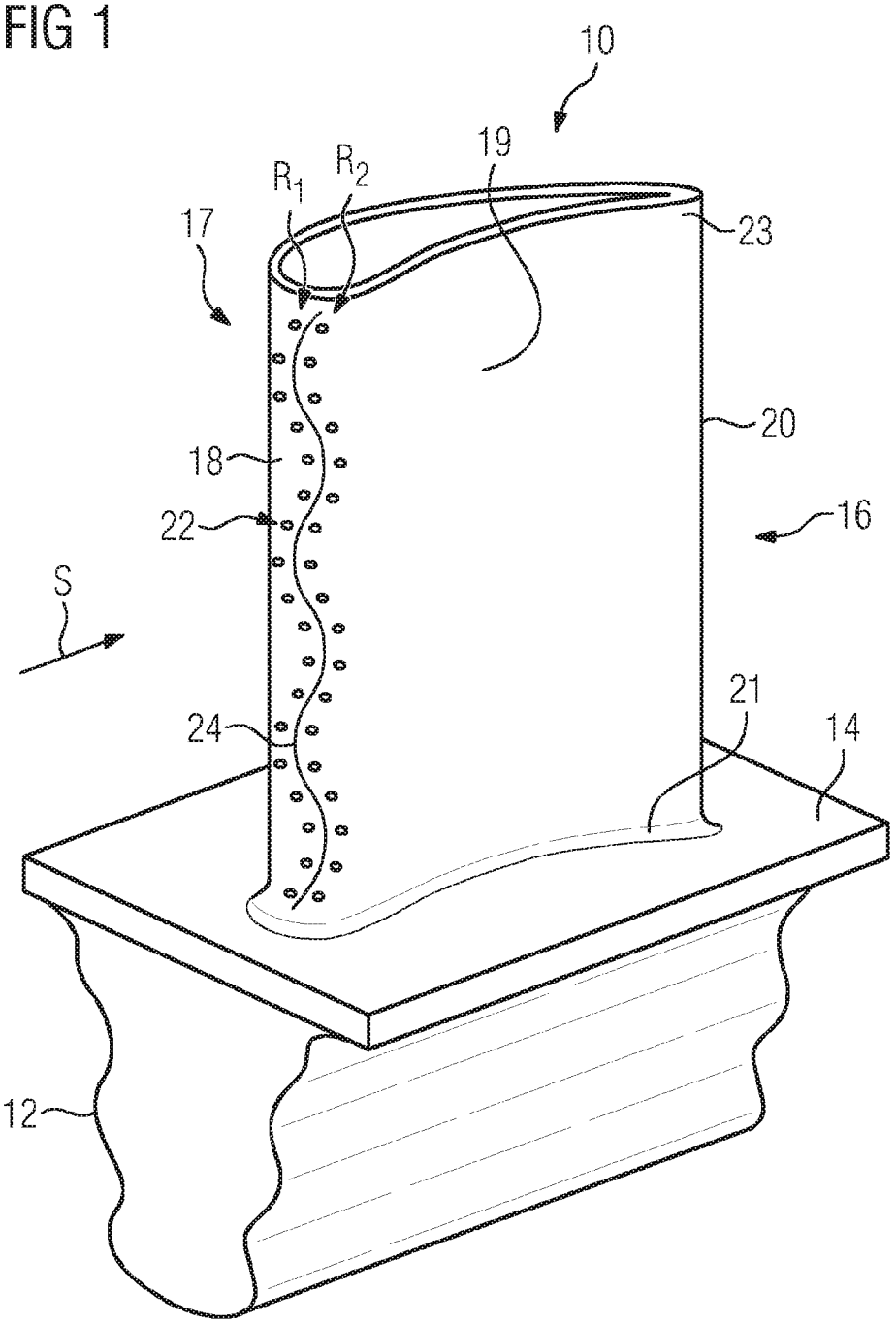
FIG. 1 shows, in a perspective illustration, a turbine rotor blade having an airfoil according to the invention as per a first exemplary embodiment.

FIG. 1 illustrates a turbine rotor blade 10 in a perspective illustration. The turbine blade 10 comprises in succession a substantially fir tree-shaped blade root 12 which is adjoined by a hot gas platform 14 as an end wall. An airfoil 16 according to the invention as per a first exemplary embodiment is arranged on that surface of said hot gas platform which faces the hot gas S. The airfoil 16 is known to comprise a leading edge 18 and a trailing edge 20, between which a suction-side wall 17 and a pressure-side wall 19 extend. In a transverse direction with respect thereto, the airfoil 16 extends from a root-side end 21 at 0% airfoil height to a tip-side end 23 at 100% airfoil height. Two series $R_1$, $R_2$ of cooling holes 22 are arranged along the leading edge 18. The two series $R_1$, $R_2$ run along a wavy line having multiple wave troughs and wave peaks and are simultaneously arranged on both sides of a central stagnation point line 24.

Figure 2:
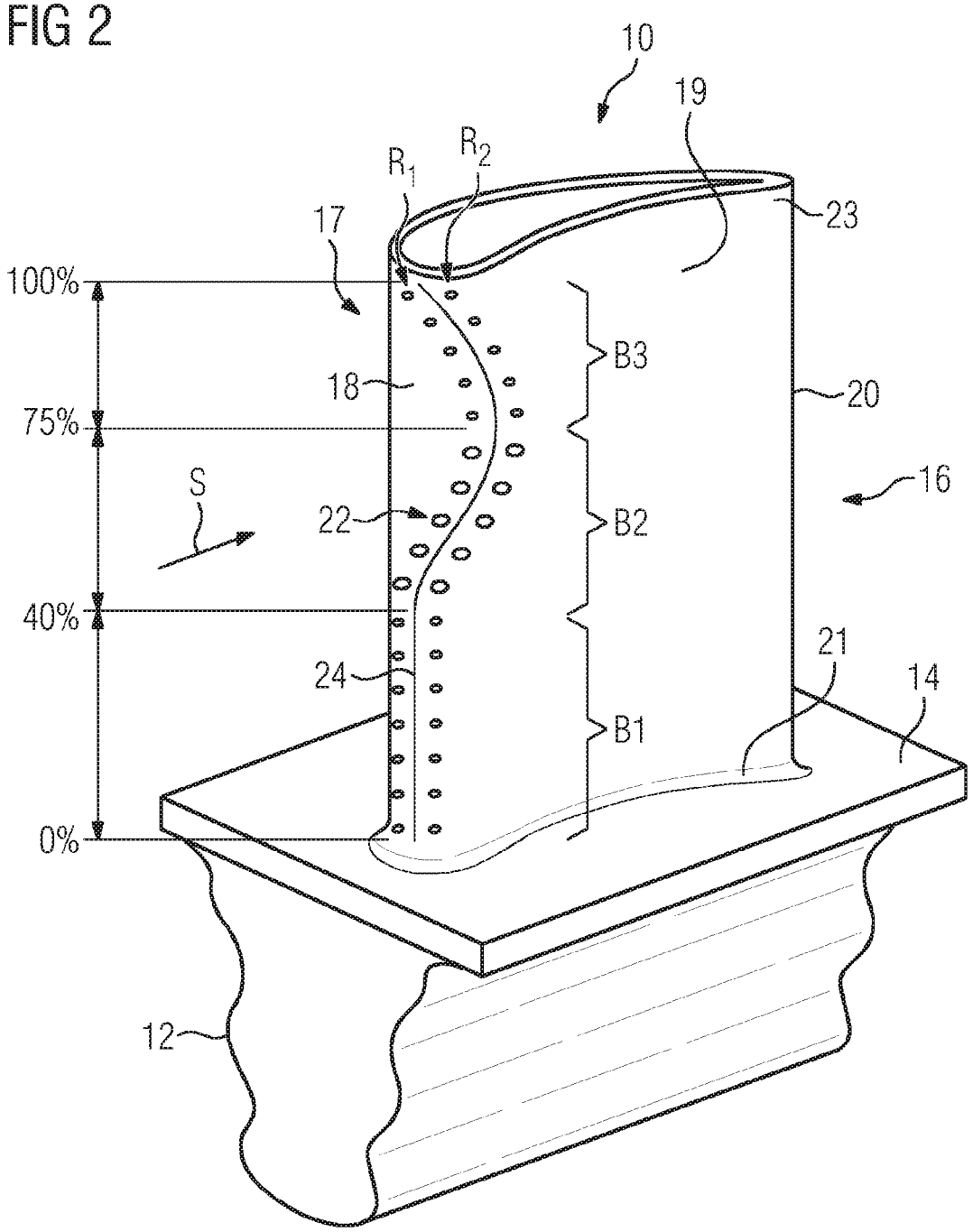
FIG. 2 shows, in a perspective illustration, a turbine rotor blade having an airfoil according to the invention as per a second exemplary embodiment.

A second exemplary embodiment of the invention is illustrated in FIG. 2. Here, instead of the totally wave-like arrangement of cooling holes 22 in the series $R_1$, $R_2$, there is a straight region followed by a bulged section. In detail, the two series $R_1$, $R_2$ of cooling holes 22 are, in the first, radially inner region, arranged so as to be arranged parallel to the leading edge 18 on both sides of the latter. This first region $B_1$ extends between 0% and approximately 40% airfoil height. Radially outwardly adjoining said first region there is provided a second region $B_2$. This ends at an airfoil height of approximately 75%. In this region, the cooling holes 22 of both series $R_1$, $R_2$ are displaced further in the direction of the pressure side with increasing height until, at approximately 75% airfoil height, they have reached the maximum displacement away from the leading edge 18. In the third region $B_3$, adjoining said second region, the cooling holes 22 of the two series $R_1$, $R_2$ are shifted back in the direction of the leading edge 18 again.

With the aid of the two illustrated exemplary embodiments, it is possible to adapt the leading edge 18 of the turbine blade 10 for different incident flow conditions and different modes of operation while achieving, with moderate use of cooling medium, cooling of the leading edge 18 that is still sufficient. In particular through the use of only two series $R_1$, $R_2$ of cooling holes 22 instead of three series, the production outlay for the turbine blade 10 can be reduced significantly. A smaller number of cooling holes 22 means at the same time that the risk of generation of cracks has been lowered. Furthermore, the amount of cooling medium, for example cooling air, is reduced, which contributes to the increase in turbine efficiency.

In both figures, the cooling holes 22 are illustrated merely schematically as circles, wherein their throttle cross sections have been illustrated schematically by circles of different sizes. It goes without saying that the cooling holes 22 may be film-cooling holes, which have a diffuser-like opening. The diffuser thereof may even be of profiled form. It is also possible for a spacing A between the cooling holes 22, which spacing is to be measured transversely on the surface of the airfoil 16, to be of a different size at different airfoil heights.

Figure 3:
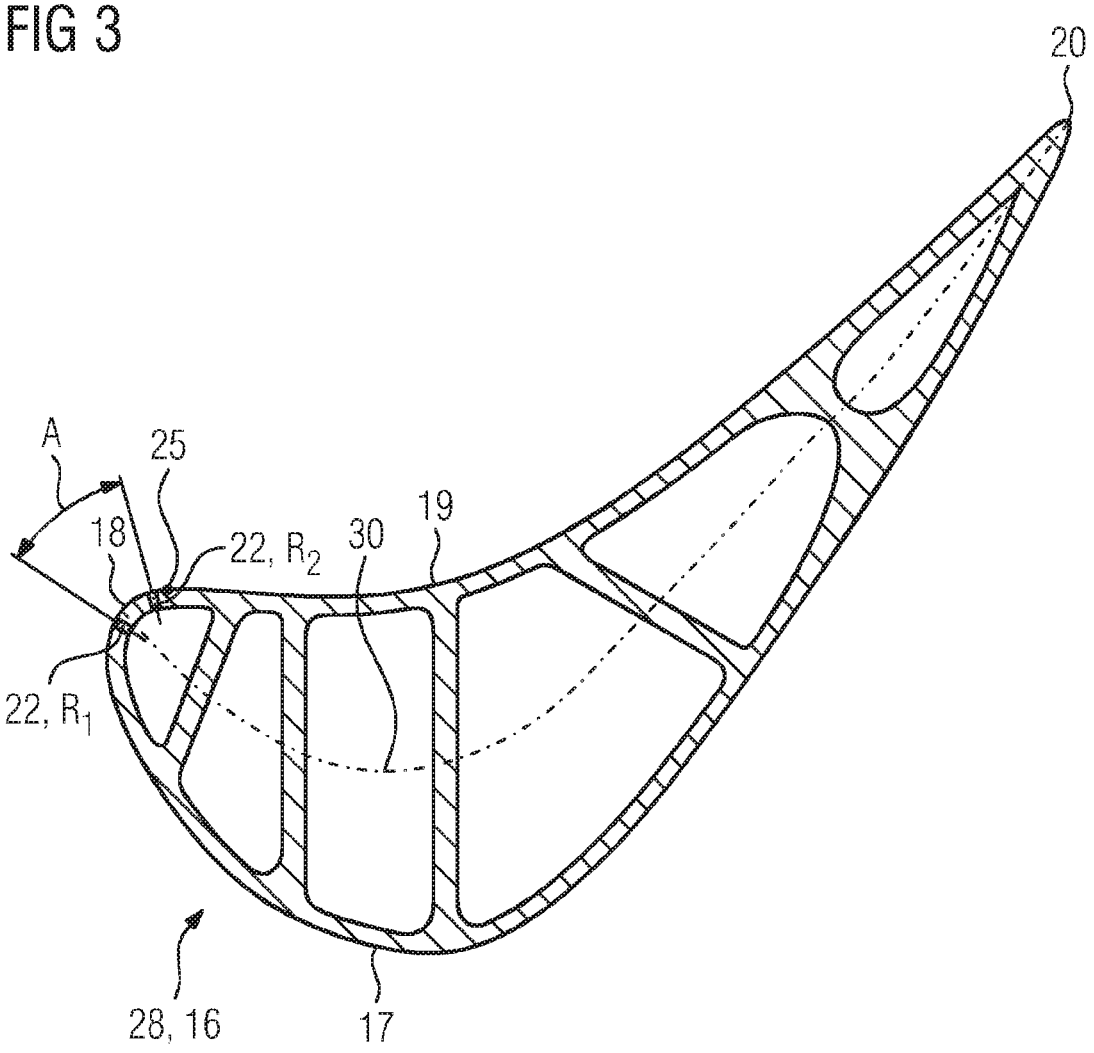
FIG. 3 shows the blade profile of the airfoil according to the first exemplary embodiment.

FIG. 3 shows moreover, as a blade profile 28, the cross section through the airfoil 16 of the first exemplary embodiment as per FIG. 1. An imaginary line, known as the blade profile midline or else as the camber line, extends centrally between the suction-side wall 17 and the pressure-side wall 19. The blade profile midline is denoted by the reference sign 30. That point of the blade profile midline 30 which is arranged right at the front defines the leading edge 18. Depending on the actual incident flow or incorrect incident flow on the blade profile 28, the stagnation point 25 may be slightly displaced off the leading edge 18 to the pressure side 19 or to the suction side 17. The (central) stagnation points 25 of each blade profile section, which are able to be determined at arbitrary airfoil heights, together form the stagnation point line 24. The nose radius is denoted by R.

Figure 4:
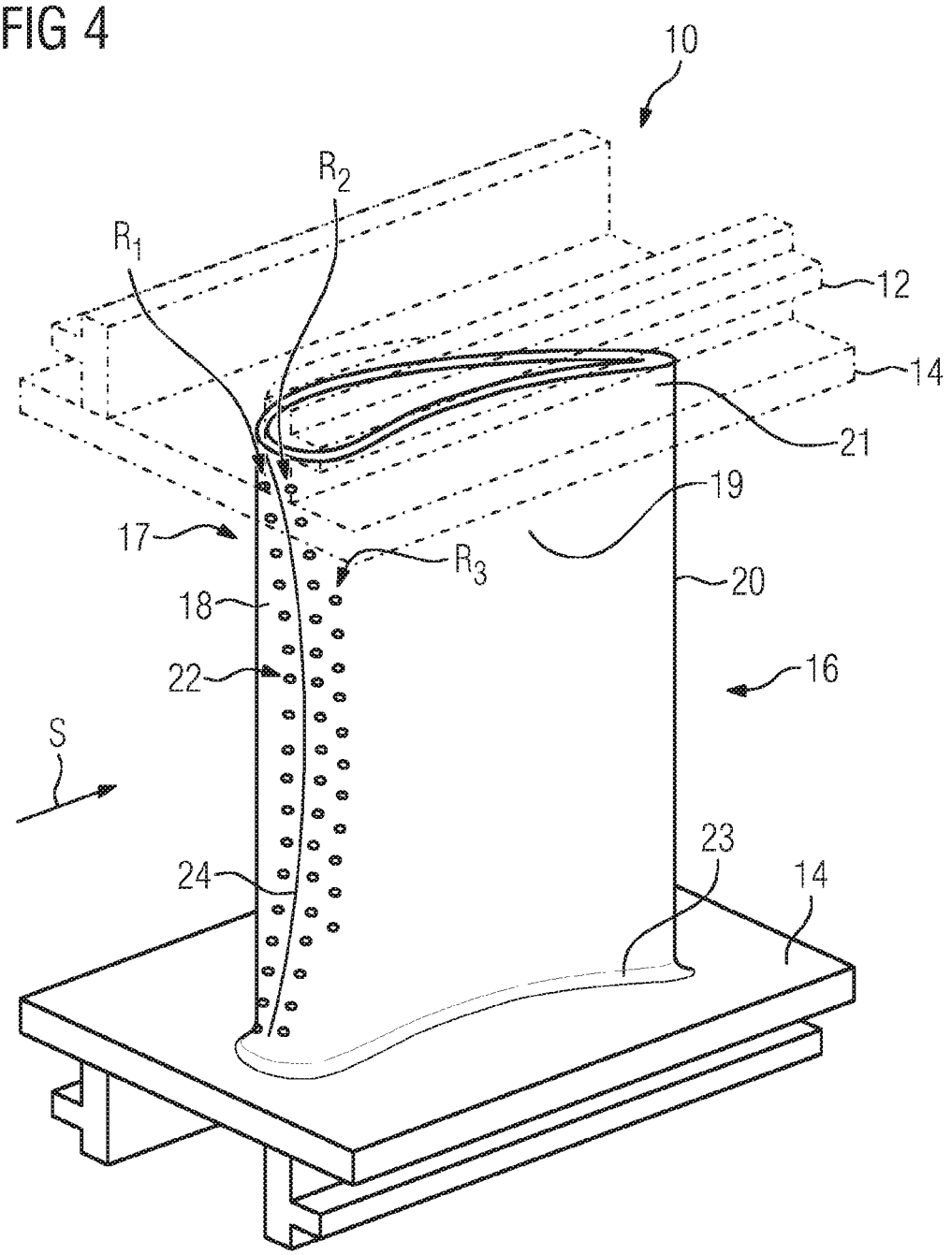
FIG. 4 shows, in a perspective illustration, a turbine guide blade having an airfoil according to the invention as per a third exemplary embodiment.

A third exemplary embodiment of the invention is illustrated in FIG. 4. It shows a perspective view of a turbine blade in the form of a guide blade, wherein the blade root 12 comprises two hook-like rails for fastening the blade to a blade carrier (not illustrated further). By contrast to the rotor blade illustrated in FIG. 1, a platform 14 for limiting the flow path is provided both at the root-side end 21 and at the tip-side end 23 of the airfoil. The airfoil 16 extends therebetween, along its airfoil height. As detailed investigations have shown, for such guide blades, the stagnation point line 24 is noticeably displaced in the direction of the suction side toward the ends 21, 23 of the airfoil 16. Accordingly, it is also the case that the at least two series $R_1$, $R_2$ of cooling holes 22 are arranged analogously: starting with the cooling holes at the airfoil mid-height, within each series $R_1$, $R_2$, the cooling holes arranged with a spacing to the platforms 14 which becomes smaller are arranged further to the suction side. The stagnation point line 24 is slightly curved, without a change in sign of its curvature. Moreover, a further, albeit shortened, series of substantially uniformly spaced-apart cooling holes 22 is provided beside the two series $R_1$, $R_2$ on the pressure side. According to this exemplary embodiment, this further series $R_3$ is arranged centrally between the two platforms 14 or the two ends 21, 23 and extends only over a length of 55% of the airfoil height. It is thus shorter than the two series $R_1$, $R_2$. If required, further, isolated cooling holes close to the leading edge may be provided locally.

Altogether, the invention relates to an airfoil 16 for a turbine blade 10, comprising a leading edge 18 against which a hot gas S is able to flow and from which a suction-side wall 17 and a pressure-side wall 19 extend to a trailing edge 20 of the airfoil 16, wherein, in a transverse direction with respect thereto, the airfoil 16 extends from a root-side end 21 at an airfoil height of 0% to a tip-side end 23 at an airfoil height of 100%, said airfoil having two series $R_1$, $R_2$ of cooling holes 22 that are arranged along the leading edge, which, with respect to one another, have a first spacing A which is to be measured perpendicularly to the leading edge 18. In order to provide a turbine blade which, with a reduced outlay in terms of cooling, is, for different operating conditions, able to be used for cooling of the leading edge 18 that is still reliable, it is proposed that the two series $R_1$, $R_2$ of cooling holes 22 are arranged at least partially on a wavy line along the leading edge 18.

The invention claimed is:

1. A hollow airfoil for a turbine blade, comprising:

a leading edge against which a hot gas is able to flow and from which a suction-side wall and a pressure-side wall extend to a trailing edge of the airfoil, wherein, in a transverse direction with respect thereto, the airfoil extends from a root-side end at an airfoil height of 0% to a tip-side end at an airfoil height of 100%, at least two series of cooling holes that are arranged along the leading edge, which, with respect to one another, have a first spacing which is to be measured perpendicularly to the leading edge, wherein the at least two series of cooling holes are arranged at least partially on a wavy line along the leading edge, and wherein a blade profile is able to be determined for any airfoil height, which blade profile has a nose radius in a region of the leading edge, wherein, at the height of cooling holes, the blade profiles have between the at least two series a first spacing whose size lies in the range between 0.4 and 0.7 times the associated nose radius.

2. The airfoil as claimed in claim 1, wherein the at least two series of cooling holes are arranged on a wavy line along an entire extent of the leading edge between 0% and 100% airfoil height.

3. The airfoil as claimed in claim 1, wherein the at least two series of cooling holes are arranged only partially on a wavy line along the leading edge, such that the at least two series of cooling holes are, in a first region, which is arranged between 0% and approximately 40% airfoil height, arranged on both sides of the leading edge in a substantially parallel manner and, in a second region, which directly adjoins said first region and extends between approximately 40% and approximately 75% airfoil height, arranged so as to be shifted to the pressure side, and wherein the at least two series of cooling holes are, in a third region, which directly adjoins the second region and ends at 100% airfoil height, arranged so as to be shifted back further toward the leading edge with increasing airfoil height.

4. The airfoil as claimed in claim 3, wherein, from an airfoil height of 40%, the at least two series of cooling holes are displaced to the pressure side such that a point of maximum displacement on the pressure side is arranged at approximately 75% airfoil height or higher.

5. The airfoil as claimed in claim 4, wherein the maximum displacement on the pressure side is from 2% to 10% of a blade chord length, which corresponds to an axial spacing between the leading edge and the trailing edge, measured at the airfoil height of the maximum displacement.

6. The airfoil as claimed in claim 1, wherein the first spacing between the at least two series varies along the leading edge.

7. The airfoil as claimed in claim 1, wherein the first spacing, at an airfoil mid-height, is at its smallest and increases toward the two ends.

8. The airfoil as claimed in claim 1, wherein each cooling hole has a throttle cross section which sets a cooling medium throughflow, wherein the throttle cross sections of some cooling holes are of different sizes.

9. The airfoil as claimed in claim 8, wherein the throttle cross sections of the cooling holes in the region of an airfoil mid-height are larger than the throttle cross section of the cooling holes in the region further away from the airfoil mid-height.

10. The airfoil as claimed in claim 1, wherein the at least two series of cooling holes are arranged on both sides of a stagnation point line of an incoming hot-gas flow.

11. The airfoil as claimed in claim 1, wherein the wavy line, without a change in sign of its curvature, is slightly curved in such a way that, both at the root-side end and at the tip-side end of the airfoil, the cooling holes of each of the at least two series are arranged further to the suction side than the cooling holes of the corresponding series at an airfoil mid-height.

12. The airfoil as claimed in claim 11, wherein, beside the at least two series, a further series of cooling holes is provided adjacently on the pressure side, wherein a length of the further series is between 50% and 60% of the airfoil height, and the further series is arranged substantially centrally between the two ends of the airfoil.

13. A turbine blade for a stationary gas turbine, comprising:

an airfoil as claimed in claim 1.

14. The turbine blade of claim 13, wherein the turbine blade comprises a turbine guide blade.

15. An airfoil for a turbine blade, comprising:

a leading edge against which a hot gas is able to flow and from which a suction-side wall and a pressure-side wall extend to a trailing edge of the airfoil, wherein, in a transverse direction with respect thereto, the airfoil extends from a root-side end at an airfoil height of 0% to a tip-side end at an airfoil height of 100%, at least two series of cooling holes that are arranged along the leading edge, which, with respect to one another, have a first spacing which is to be measured perpendicularly to the leading edge, wherein the at least two series of cooling holes are arranged at least partially on a wavy line along the leading edge, wherein each cooling hole has a throttle cross section which sets a cooling medium throughflow, wherein the throttle cross sections of some cooling holes are of different sizes, and wherein the throttle cross sections of the cooling holes in the region of an airfoil mid-height are larger than the throttle cross section of the cooling holes in the region further away from the airfoil mid-height.

16. An airfoil for a turbine blade, comprising:

a leading edge against which a hot gas is able to flow and from which a suction-side wall and a pressure-side wall extend to a trailing edge of the airfoil, wherein, in a transverse direction with respect thereto, the airfoil extends from a root-side end at an airfoil height of 0% to a tip-side end at an airfoil height of 100%, at least two series of cooling holes that are arranged along the leading edge, which, with respect to one another, have a first spacing which is to be measured perpendicularly to the leading edge, wherein the at least two series of cooling holes are arranged at least partially on a wavy line along the leading edge, and wherein the wavy line, without a change in sign of its curvature, is slightly curved in such a way that, both at the root-side end and at the tip-side end of the airfoil, the cooling holes of each of the at least two series are arranged further to the suction side than the cooling holes of the corresponding series at an airfoil mid-height.

* * * * *